United States Patent [19]

Chunat et al.

[11] 4,060,433

[45] Nov. 29, 1977

[54] FOAM PHOSPHATIZING METHOD AND COMPOSITION

[75] Inventors: Gerald W. Chunat, Apple Valley; James E. Maloney, Eagan, both of Minn.

[73] Assignee: Economics Laboratory, Inc., St. Paul, Minn.

[21] Appl. No.: 664,165

[22] Filed: Mar. 5, 1976

[51] Int. Cl.[2] ..... C23G 7/08

[52] U.S. Cl. ..... 148/6.17; 148/6.15 R; 252/307; 252/350

[58] Field of Search ..... 148/6.15 R, 6.15 Z; 252/307, 350, 6.17

[56] References Cited

U.S. PATENT DOCUMENTS

| | | | |
|---|---|---|---|
| 1,329,573 | 2/1920 | Allen | 148/6.15 R |
| 2,657,156 | 10/1953 | Hyams et al. | 148/6.15 R |
| 2,724,668 | 11/1955 | Russell | 148/6.15 R |
| 3,060,066 | 10/1962 | Ross et al. | 148/6.15 R |
| 3,152,018 | 10/1964 | Pollard | 148/6.15 R |
| 3,420,715 | 1/1969 | Ayres | 148/6.15 R X |
| 3,511,784 | 5/1970 | Riggs et al. | 252/307 X |
| 3,615,912 | 10/1971 | Dittel et al. | 148/6.15 R |
| 3,726,720 | 4/1973 | Guhde | 148/6.15 R |
| 3,729,346 | 4/1973 | Gotta et al. | 148/6.15 R X |

*Primary Examiner*—Harris A. Pitlick
*Attorney, Agent, or Firm*—Norman P. Friederichs

[57] ABSTRACT

The disclosed foamable phosphatizing compositions comprise a phosphatizing agent combined with a high-foaming surfactant. When mixed with a gas such as air, the composition provides a relatively stable foam which adheres to overhead or inclined or vertical metal surfaces. When the foam has been in place on the metal surface for a certain minimum dwell time (and the coating weight has reached at least 10mg/ft$^2$), the phosphatizing composition is rinsed off or is permitted to drain off. By procedures which involve reproducible laboratory tests, maximum and minimum dwell times or contact times can be determined even for use in the field under poorly controlled conditions. As a result, the control over the resulting phosphate coating weights is comparable to the control obtainable in immersion techniques or tunnel sprayer techniques. This high degree of control in a foam spraying technique makes possible an efficient, economical method for spray-phosphatizing bulky three-dimensional objects or inclined or overhead surfaces, regardless of whether or not reuse of the phosphatizing composition is a realistic possibility.

19 Claims, No Drawings

FOAM PHOSPHATIZING METHOD AND COMPOSITION

CROSS REFERENCE TO RELATED APPLICATION

U.S. Pat. application Ser. No. 627,082 of James E. Maloney, filed Oct. 30, 1975 now U.S. Pat. No. 4,017,335 discloses liquid phosphatizing concentrates technology.

FIELD OF THE INVENTION

This invention relates to the treatment of metal surfaces for the purpose of reducing their susceptibility to corrosion and/or to prepare them for coating operations, e.g. painting. An aspect of this invention relates to an art generally referred to as "phosphatizing" or "phosphating", i.e. the treatment of a metal surface to provide a coating of relatively compact, insoluble metal phosphates strongly adherent to the metal. A further aspect of this invention relates to the phosphatizing of vertical, inclined, or overhead surfaces, particularly surfaces of three-dimensional objects. Still another aspect of this invention relates to a method for providing a phosphatizing foam with a controlled degree of stability, which foam will adhere to a metal surface for at least a certain minimum dwell time. Still another aspect of this invention relates to liquid concentrates suitable for dilution with water or organic solvents and for combination with gaseous fluid (e.g. air) in a foaming and/or foam-spraying device.

DESCRIPTION OF THE PRIOR ART

In the so-called phosphatizing art, an acidic phosphatecontaining composition is brought into contact with a metal (e.g. a ferrous metal) surface. It has been a consistent goal of the art to reduce contact times; however, useful contact times may vary greatly depending upon the objective and conditions of the phosphatizing process. For example, in some phosphatizing processes, it is unlikely that the time of contact between the phosphatizing solution and the metal surface would ever be too long, and, in the early days of the phosphatizing art, contact times could be extremely long. In other processes, adverse results can actually result from too long a contact time.

The phosphatizing treatment results in the formation of a layer of densely-packed crystals on the metal surface. These crystals, to some extent, resist corrosion. Perhaps even more important, the crystalline layer provides a good base for a coating composition such as a paint. The thickness or coating weight of the crystalline layer obtained in the phosphatizing process is a function of several variables, including contact time, concentration and type (if any) of accelerator system (i.e. oxidizing agent) in the phosphatizing composition, temperature of the phosphatizing composition, and the like.

Phosphatizing can be carried out by dipping the metal article into a bath or spraying a suitable solution onto the metal surface. In the bath or immersion technique, control over contact time, solution temperature, etc. is relatively easy to regulate. Such regulation can be more difficult in the spraying technique, particularly if the surface to be sprayed is inclined from the horizontal or is located above the sprayhead. Control over phosphatizing contact times can be particularly impractical in the case of large objects, e.g. partially or fully assembled vehicles (trailers, tractors, cabs, farm equipment, etc.), dust collectors, and room-like enclosures with interior metal walls and/or ceilings. In some cases, it may be impossible or totlly impractical to use the immersion technique with such objects. The spray technique is generally moe effective in such cases, particularly if the object can be mounted on a conveyor belt and passed through a spray tunnel which is provided with a recirculating system for reusing the sprayed solution. Some objects are even difficult to treat in this manner; furthermore, the construction of a spray tunnel can be complicated or expensive.

In recent years, great strides have been made in the development of portable spray equipment. Examples of such equipment include the "MAGNUS" (registered trademark) "FOAM AND CLEAN" systems. For additional disclosures relating to spraying equipment (including foam-spraying equipment) see the following references:

| U.S. Pat. No. | Patentee | Issue Date |
|---|---|---|
| 2,388,508 | Timpson | November 6, 1945 |
| 2,640,724 | Sanders et al | June 2, 1953 |
| 3,383,044 | Norstrud et al | May 14, 1968 |
| 3,388,868 | Watson et al | June 18, 1968 |
| 3,701,482 | Sachnik | October 31, 1972 |
| 3,822,217 | Rogers | July 2, 1974 |

For a disclosure of a method of increasing and stabilizing foam by adding polymers to the foam-forming composition prior to formation of the foam (which foams are useful in pickling and cleaning operations), see U.S. Pat. No. 3,681,253 (Arthur et al), issued Aug. 1, 1972.

As mentioned previously, control over contact times in the art of spray phosphatizing can be so troublesome as to shed doubt upon the adaptability of modern advances in spraying technology and portable spray equipment to the phosphatizing art, unless the metal surface to be phosphatized is in a substantially horizontal position (below the sprayhead) and/or the desired phosphate coating weight is less than 10mg/ft$^2$ (i.e. less than about 105mg/M$^2$). Another problem encountered when one sprays a phosphatizing liquid onto a metal surface is the hazard to the operator of the equipment resulting from back-blast or bounceback of the spray, resulting from reflectance of the spray pattern back towards its point of origin at the sprayhead.

Of course, it may be possible to spray a liquid phoshatizing composition onto a vertical or inclined metal panel and permit the impinging liquid to run off quickly in the hope that some residue of phosphatizing agent will remain in sufficient amounts on the surface, so that a phosphate coating will build up through the action of this relatively small amount of agent. Control over the amount and uniformity of residue may be especially difficult in this situation, due to channelling or rivulet formation and resulting in a coating with streaky appearance.

The art generally relating to the spraying of metal panels and the like with a phosphatizing composition is vast. The following reference contains a disclosure of a phosphatizing spray technique (see, for example, Examples 16 and 17) wherein phosphate coating weights of up to 50mg per square meter are reported:

U.S. Pat. No. 3,899,364 (Evans et al), issued Aug. 12, 1975.

SUMMARY OF THE INVENTION

It has now been found that adequate control over the phosphatizing of a non-horizontal or overhead metallic surface (e.g. a ferrous metal surface) can be obtained with a phosphatizing composition and a spraying technique which produces an adherent foam. In connection with this technique, procedures have been developed which permit a degree of control over phosphate coating weights comparable to the control obtainable in immersion techniques or tunnel sprayer techniques. These procedures involve the determination of the "single-pass, vertical, ASTM D 609-61 panel dwell time", which will be defined subsequently. With careful selection of the foam-producing ingredients (e.g. air and high-foaming surfactants), a relationship between this "single-pass, vertical, ASTM D 609-61 panel dwell time" and the corresponding actual dwell time of the foam deposits on the surface (i.e. the actual dwell time needed to produce an adherent phosphate coating weight of at least 10mg/ft$^2$) can also be determined; alternatively, experimental techniques for determining approximate ratios between clean panel dwell times and actual dwell times can be provided.

The method of this invention involves providing a mixture containing: (a) a phosphatizing composition containing at least 0.2% by weight of phosphate anions and having a pH ranging from about 3.0 to about 5..5; (b) at least about 0.25 parts by weight, per 100 parts by weight of said phosphatizing composition, of a high-foaming surfactant; and (c) a volume of gaseous fluid (e.g. air) which is relatively larger than the combined volume of the phosphatizing composition and the high-foaming surfactant; and this mixture is used to generate a foam spray which is directed onto a non-horizontal or overhead metallic surface to obtain an adherent foam deposit on this surface (the foam spray has adherent properties with respect to the surface). The foam deposit which results on the metallic surface is allowd to remain in place until a phosphate coating weight of at least 10mg/ft$^2$ (about 105mg/M$^2$) is obtained and until the adherent foam deposit has been in place for a single-pass, actual dwell time which inherently corresponds to a "single-pass, vertical, ASTM D 609-61 panel dwell time" of about 10–180 seconds.

The high-foaming surfactant should have an initial Ross-Miles foam height in excess of 10 centimeters, determined at 0.1% by weight concentration in water in a column of zero hardness water maintained at 50° C.

A particularly preferred phosphatizing composition which can be foamed with air comprises:

0.75–4.0 parts by weight phosphoric or polyphosphoric acid;

about 1 equivalent of an amine for each 3 equivalents of said acid;

0–1.5 parts by weight of an accelerator and/or debronzing agent;

optionally, 0–1.5 parts by weight of a compound of the formula $H_2MF_6$, wherein M is an element of Group IVA or IVB of the Periodic Table.

If the above composition is in concentrate form, it can contain a small amount of either water or an organic solvent. In use, the composition can be diluted with up to 100 parts by weight of water or solvent.

DEFINITIONS

Generally speaking, this invention relates to the type of phosphatizing art described in U.S. Pat. No. 3,060,066 (Ross et al), issued Oct. 23, 1962, and the following definitions of terms in that reference are incorporated herein by reference: "non-coating", "iron", and "iron-on-iron". That is, using the nomenclature of Ross et al, column 1, the use solutions produced according to this invention are classifiable as "non-coating", "iron", and "iron-on-iron".

Other definitions used herein are as follows:

"drainable surface" denotes a surface from which a flowable material, deposited on the surface, can drain off or flow off or drip off under the influence of gravity. Thus, "drainable surfaces" include upside down (i.e. overhead) surfaces and nonhorizontal surfaces (e.g. vertical or inclined surfaces). Although any inclined surface can be a "drainable surface" within this context, steeply inclined surfaces, of course, provide much better draining, e.g. surfaces inclined more than 5° or 10° from the horizontal.

"single-pass, vertical, ASTM D 609-61 panel dwell time" denotes the amount of time that a deposit of phosphatizing foam produced according to this invention, deposited by means of a single pass of a foam sprayhead, is permitted to remain in phosphatizing contact with a steel panel specially prepared for testing of coatings, the preparation being carried out in accordance with the American Society for Testing and Materials (ASTM) standard method ASTM D 609-61 (reapproved 1968). The method for determining the "single-pass", vertical, ASTM D 609-61 panel dwell time is as follows:

a. for the determination, of course, one uses a panel which is oriented vertically and meets the specifications of ASTM D 609-61. Panels are commercially available (e.g. from the Q-Panel Company of Cleveland, Ohio) which have been prepared according to ASTM D 609, which are specially packaged to be ready for use, and which are each provided with a $\frac{1}{4}$ inch hole. These panels (e.g. "Q-Panel", Type S) are available in sizes ranging from 2 $\frac{3}{4}$ in. × 5 $\frac{7}{8}$ in. to 6 in. × 12 in. The Type S panels are ground on one side. "Q-Panels", in addition to meeting ASTM D-609, also meet Federal Test Standard No. 141, Method 2011.

b. the "ASTM D 609-61 panel" (i.e. the panel which meets ASTM D 609-61) is oriented vertically and sprayed with a foamed phosphatizing composition. One layer of foam is applied in a single pass of the foam sprayhead. A suitable device for applying the foam to the panel is the "MAGNUS" (trademark) 10-gallon or 50-gallon "Foam and Clean" unit; for specifications of this unit, see "Foam Cleaning Dispensing Systems", publication number 8613/0900/1273 of Magnus Division of Economics Laboratory, Inc., Osborn Bldg., St. Paul, Minnesota 55102. Another suitable type of foam dispensing equipment is the "Porta-Washer", Model S or Model P; see publication 8612/9092/065 of Magnus Division of Economics Laboratory, Inc. See also U.S. U.S. Pat. No. 3,961,754, filed 9-12-75.

c. if the layer of foam sprayed onto the vertical ASTM D 609-61 panel begins to sag or drain from the panel within 180 seconds, note the time when sagging or draining begins and the time when the draining off of the foam layer is complete.

d. if the foam layer deposited upon the vertical ASTM D 609-61 panel is so stiff, dry, and stable that no draining has occurred within 180 seconds, rinse off the foam layer with a water spray at the end of the 180 second period and check the surface of the panel for non-adherent, powdery deposits. If powdery deposits are found, repeat the test several times, each time with a fresh ASTM D 609-61 panel using steps (a), (b), and a water rinse, the water rinse being initiated after a predetermined time which is less than 180 seconds. By repeating this series of steps with a series of panels, using shorter and shorter dwell times, eventually it will be possible to determine a time less than 180 seconds which does not result in the formation of the powdery deposits. This shorter time will be noted as the "dwell time" in lieu of the time arrived at according to step (c). On the other hand, if the aforementioned stiff, dry, stable foam layer, when rinsed after a 180 second dwell time, has not produced the powdery deposits, the dwell time can be assumed to be approximately 180 seconds.

e. check the phosphate coating weight found according to either step (c) or step (d). The coating weight should be greater than 10 milligrams per square foot (greater than about 105mg/$M^2$). If a phosphate coating weight of at least 10mg/$ft^2$ has been found, it can be assumed that the "single-pass, vertical, ASTM D 609-61 panel dwell time" has been determined correctly. If the coating weight is less than 10mg/$ft^2$, and if no powdery deposits have formed on the panel as a result of the phosphatizing contact between the foam and the panel, the dwell time is longer than indicated by the determination of step (c) or (d), and the determination should be repeated until a dwell time has been found which produces a coating weight greater than 10mg/$ft^2$ without also producing powdery, non-adherent deposits. In the preferred practice of this invention, it is ordinarily the case that the "single-pass, vertical, ASTM D 609-61 panel dwell time" is determined by steps (a), (b), and (c), whereby the foam spontaneously lifts off the surface of the vertical panel and begins to drain spontaneously after a dwell time of less than 180 seconds, e.g. 10–100 seconds, more typically at least 30 seconds. For reasons which will be considered subsequently, the dwell time on a clean, vertical panel (e.g. an ASTM D 609-61 panel) appears to be self-regulated, provided that the invention is practiced in the preferred manner. "single-pass, actual dwell time" denotes the actual time needed to obtain a phosphate coating greater than 10mg/$ft^2$, preferably greater than 20mg/$ft^2$ (about 215mg/$M^2$) without producing the aforementioned powdery, non-adherent deposits on the metal surface. That is, the practical application of this invention in the field is not limited to clean, vertical metal surfaces; the invention can be applied to drainable metal surfaces which may be covered with soil, oily deposits, grease, or the like. In the method of this invention, the foamed phosphatizing composition is preferably provided with a de-greasing capability. It has been found that the de-greasing action slows down or postpones the phosphatizing action. Thus, "single-pass, actual dwell time", though it also involves only a single pass of the foam spray across the metal surface, is ordinarily longer than the "single-pass, vertical, ASTM D 609-61 panel dwell time" by a factor of up to about 50 or 100. That is, one can assume that these two dwell times are related by a multiple which can range from about 1 to 50 or 100, typically more than 1 but less than 35, depending upon the amount of soil, oily deposits, grease, etc. on the surface of the actual specimen being phosphatized (hence the amount of de-greasing time required). The addition of hydrocarbon solvent and wetting agents to the phosphatizing composition greatly reduces the de-greasing time. Thus, typical "single-pass, actual dwell times" range from about 30 or 60 seconds to about 5, 10, or even 15 minutes for "dirty" metal surfaces. All of the assumptions regarding the actual dwell time in the practice of this invention can, of course, be altered somewhat through the use of a plurality of passes of the foam head, resulting in a plurality of layers of foamed phosphatizing composition. However, since good results are obtained with a single pass of the foam head, the method of the invention can be described with respect to a single pass under actual conditions as well as laboratory conditions.

"Cessation of phosphatizing action" denotes either the rinse step or the spontaneous sagging or draining step described in the definition of "single-pass, vertical, ASTM 609-61 panel dwell time". In this invention, the preferred technique for cessation of phosphating action is the spontaneous sagging or draining of the foam, regardless of whether the metal specimen being treated is a clean, vertically-oriented laboratory panel or the drainable surface of a metal object being treated under the relatively uncontrolled conditions of practical application.

"phosphate", as used in this application, denotes orthophosphate (which can be represented, in anionic form, as $PO_4^{-3}$), monohydrogenphosphate (as an anion, this can be represented as $HPO_4^{-2}$), dihydrogenphosphate (as an anion, represented as $H_2PO_4$—) and pyrophosphates, tripolyphosphates, or other higher condensed polyphosphates corresponding thereto.

DETAILED DESCRIPTION

Generally speaking, the practice of this invention involves providing a phosphatizing composition in foam form, i.e. in the form of a substantially flowable liquid filled with a great multitutde of gas bubbles (e.g. air bubbles). As is known in the art of cleaning, laundering, etc., two principal ingredients can make a major contribution to foaming action or to the conversion of a flowable liquid into a relatively stable or "stiff" foam. These ingredients are a fluid which is gaseous at normal ambient temperatures (e.g. air) and a high-foaming surfactant. Surfactants can exhibit either high or low foam and good or poor foam stability, and a convenient means for screening out those surfactants which have poor foam stability tendencies is the well known Ross-Miles test; see U.S. Pat. No. 2,315,983 (J. Ross, et al), issued Apr. 6, 1943. In screening surfactants for use in this invention, it is preferred to make the Ross-Miles foam height determination at 0.1% by weight concentration in water in a column of zero hardness water maintained at 50° C. Under these conditions, the initial foam height should be in excess of 10cm, and only moderate foam height decay will be observed after 5 minutes.

In the preferred practice of this invention, a phosphatizing composition, in liquid form, is combined with a relatively large volume of air or other gaseous fluid in a suitable foamforming apparatus. The foam is dispensed from a sprayhead in a manner similar to the spraying of foam cleaners. Several differnt types of apparatus are known and are commercially available for the purpose of generating and/or spraying foam. The foam can be generated in a reservoir and then simply dispensed from a simple sprayhead, or, more preferably, foam-forming ingredients can be proportioned with air at or near the sprayhead, e.g. in the "wand" of a spraying device. These various types of apparatus can be adapted to handle one-part or two-part or other multi-part systems. A phsophatizing composition useful in this invention can, accordingly, comprise one or more parts. For example, the essential ingredients of the phosphatizing composition can be in the form of a dry powder or liquid concentrate suitable for dilution with water and/or organic solvents. After dilution, this system could be considered a "one-part" phosphatizing composition which need only be combined with air to produce the foam. The dilution, particularly in the case of the solid powder, can be carried out by mixing the active ingredients with the diluent in a storage tank and dispensing the resulting one-part system from this tank. Alternatively, particularly in the case of a liquid concentrate, the concentrate could be dispensed from a much smaller storage container (even s shipping drum or the like) and, by means of a suitable proportioner, a stream of diluent can be added to the thus-dispensed concentrate to form the diluted phosphatizing system.

For a disclosure of liquid concentrates which can be dispensed directly from a shipping container, see U.S. Pat. No. 4,017,335 of James E. Maloney, filed Oct. 30, 1975, and entitled "Liquid Phosphatizing Composition and Use Thereof". A feature of the invention disclosed in this application U.S. Pat. No. 4,017,335 is the use of an amine to neutralize various acids in the composition. In keeping with the flexibility of this invention, insofar as one-part or multipart systems are concerned, the amine and the acids can be stored in separate containers or can be combined in a single container. In typical compositions of this invention, which include phosphoric acid or polyphosphoric acid and various optional (but preferred) ingredients such as buffering agents, accelerators, anti-bronzing agents, organic solvents, coupling agents, surfactants, and neutralizing agents for the phosphoric acid and other acidic ingredients of the composition, there can be any number of ways for combining these ingredients from separate parts. Furthermore, in the liquid concentrate approach, different liquid concentrates can be mixed together in various desired ratios.

As mentioned previously, a high-foaming surfactant assists in the foam-forming step of the process. Such foam-generating or foam-boosting (or foam-stabilizing) agents can be blended directly with the phosphatizing ingredients or can also be stored in a separate container as part of a multi-part system. Still another alternative, which avoids the need for a separate neutralizing agent, involves the use of pre-formed phosphate salts in place of the combination of phosphoric acid and a neutralizing agent. A typical salt which can be employed for this purpose is an alkali metal phosphate, e.g. sodium dihydrogen phosphate or potassium dihydrogen phosphate.

The spray of foam which emerges from the sprayhead is directe onto a metal surface or surfaces, preferably including a drainable metal surface, so that a generally uniform layer of foam is deposited on the surface. That is, the layer on the metal surface should be substantially coextensive in area with the area to be phosphatized and should be generally free of discontinuities throughout that area. Insofar as the environment of the metal surface is concerned, ambient conditions of temperature and pressure are ordinarily suitable, e.g. 0°–40° C. and about one atmosphere of pressure. The temperature of the phosphatizing liquid fed to the sprayhead can also be at ambient temperatures or moderately elevated, e.g. up to 85° or 90° C., more typically up to about 55° C. In the preferred practice of this invention, a moderately "stiff" foam is used, i.e. a foam which is reasonably stable and can remain in place throughout the actual single-pass dwell time (e.g. up to about 20 minutes or slightly more). Such a foam will typically contain, by volume, more air bubbles than liquid, but will still be a sufficiently "wet" foam to flow under the influence of gravity from a drainable surface, once the temporary adherent bond between the foam and the metal surface relaxes or is broken by chemical changes. For example, one such moderately "stiff" foam is obtained from water and/or organic solvents, the phosphatizing ingredients, and about 0.25–10% by weight of a high-foaming surfactant component, the resulting liquid composition being combined with about 10–30 volumes of air per volume of liquid. When the preferred compromise between "wetness" and "dryness" of the foam is obtained, the dwell time and the phosphatizing reaction are self-regulating. That is, the foam remains in adherent contact with the metal surface until a phosphate coating weight in excess of 10mg/ft$^2$ is obtained (e.g. 20–100mg/ft$^2$), the phosphatizing reaction being simultaneous with or subsequent to a de-greasing action, should any de-greasing be required. When the phosphate coating weight has reached a desirable level, the foam system inherently begins to lose its adherent bond to the metal, thus paving the way for drainage of the foam from the surface and avoidance of excessive contact times. (As noted previously, excessive contact times can lead to the formation of powdery, non-adherent deposits, which are believed to be precipitated phosphates rather than densely packed phosphate crystals adhered to the metal surface.) That is: unexpectedly, the foam of preferred embodiments of this invention appears to have the inherent capability of holding in place on the metal surface until its job is done, but no longer. After the foam has done its work, it can raise up very slightly from the metal surface and drain off, largely through the influence of gravitational forces. This self-regulating phenomenon, wherein the actual dwell time on the surface of the metal is also the desired dwell time, is not fully understood. Although this invention is not bound by any theory, it is presently believed that, when the phosphate coating has reached the desired coating weight, a sufficient mass of hydrogen bubbles (resulting from acidic attack upon the metal surface) has formed at the foam/metal interface to counteract any adherent forces (e.g. hydrogen bonding or the like) which are holding the foam in place on that surface.

When the amount of water in the foam system is optimized, gravitational forces alone can, in preferred embodiments of this invention, almost literally clean off the foam through drainage effects which begin during or shortly after the cessation of phosphatizing action. Even with such optimized systems, however, it is ordinarily useful to rinse the freshly phosphatized surface with an aqueous spray, e.g. a spray of plain water, water containing detergent, or the like. In phosphatizing foam systems with a high water content, an aqueous rinse step is especially helpful in cleaning off any residue left by the departing foam.

Still another feature of this invention is the movement of foam resulting from the drainage in these preferred embodiments of the invention. Again, this invention is not bound by any theory, but it is believed that foam movement down or across the drainable metal surface assists in the phosphatizing action. Experiments have been carried out wherein compositions of this invention in an unfoamed state have been wiped on the metal surface, allowed to remain in place for a period of time, and then rinsed off. This procedure produces a significantly inferior phosphatizing action as compared to the preferred embodiments of this invention.

The cessation of phosphatizing action can be carried out by other means, including rinsing of a relatively "stiff" foam which does not begin to sag or drain off at the conclusion of the desired actual dwell time. In this approach, the dwell time is not self-regulating, but is limited by a deliberate rinsing step.

Another factor which is believed to contribute to the inherent termination of the dwell time in the self-regulating approach is foam stability. A foam which shows virtually no decay at the end of 20 minutes or more is less likely to be self-regulating than a foam which decays slightly during this period of time. Furthermore, foam decay can involve bursting of air or gas bubbles; thereby, it is believed (though this invention is not bound by any theory), continuously agitating the phosphatizing ingredients in the foam and/or constantly exposing fresh phosphatizing solution. Thus, foam decay is believed to contribute to the movement effect described previously and to constantly renew or stimulate the phosphatizing action.

FOAM-FORMING PHOSPHATIZING COMPOSITIONS

Compositions useful in this invention can be liquid concentrates or solids suitable for dilution with aqueous media or organic liquid carriers or solvents. Alternatively, the compositions can be pre-diluted to the desired use concentration. In either event, the phosphatizing composition should contain at least 0.2% by weight of phosphate anions and should have, both in concentrate and diluted form, a pH ranging from about 3.0 to about 5.5. In addition, the composition should contain at least about 0.25 parts by weight, per 100 parts by weight of the phosphatizing composition, of a high-foaming surfactant having an initial Ross-Miles foam height in excess of 10 centimeters determined at 0.1% by weight concentration in water in a column of zero hardness water maintained at 50° C. More typically, the initial Ross-Miles foam height will be at least 20 cm (200mm) initially and will be virtually unchanged (e.g. only 2 or 3 cm or 30 millimeters less) after five minutes. Generally speaking, the lack of any significant decay in foam height after five minutes is a very strong indication of high-foaming properties. With suitable high-foaming surfactants, a volume of gaseous fluid relatively larger than the combined volume of the phosphatizing chemicals and the high-foaming surfactant can be combined with the phosphatizing composition to produce a reasonably stable foam containing an enormous multitude of tiny bubbles of the gaseous fluid. As mentioned previously, the preferred gas is air.

The following illustrates typical ranges of ingredients for a foamable phosphatizing composition (i.e. a phosphatizing composition combined with a high-foaming surfactant).

| Parts by Weight | Component |
|---|---|
| 0.75–4 | phosphatizing agent, e.g. phosphoric acid |
| 0.1–1.5 | accelerator system (typically a compound selected from the group consisting of a molybdenum oxide, a molybdate salt, a nitrated aromatic sulfonic acid, a nitrated aromatic sulfonate, or mixtures thereof) |
| 0.25–10 | high-foaming surfactant |

The above-described phosphatizing composition can be made into a liquid concentrate by adding up to 100 parts by weight of water or a suitable organic carrier, e.g. a hydrocarbon liquid solvent having a flash point in excess of 85° F.* and an initial boiling point in excess of 285° F.** It is preferred that the phosphoric acid be neutralized. Liquid concentrates with excellent compatibility with water are obtained when the phosphoric acid is neutralized with about 1 to about 3 equivalents of an amine for each 3 equivalents of phosphoric acid. The pH of the liquid concentrate as well as the diluted concentrate or a dissolved solid phosphatizing composition should be within the range of about 3.0 to about 5.5. The dibasic phosphate salts (e.g. salts of the formula $MH_2PO_4$, wherein M is ammonium or monovalent metal) are generally ideal from a pH standpoint. When amines are used for neutralization of the phosphoric acid, the preferred amines are of the alkanol-substituted type, e.g. mono-, di-, or triethanol amine.

* 30° C ** 140° C.

It can be desirable to use mixtures of aqueous and organic solvents or liquid carriers in formulating liquid concentrates useful in this invention. For example, a typical concentrate can contain 20–80% by weight of diluent, wherein the diluent can be a mixture of water and a hydrocarbon solvent. It is to be understood, however, that the 20–80% diluent could be entirely water or entirely hydrocarbon solvent. When mixtures of the water and liquid hydrocarbon are used, ratios of one to the other can vary from 5:1 to 1:5. The 5:1 hydrocarbon: water diluent can provide a very low viscosity concentrate. On the other hand, the 5:1 water:hydrocarbon diluent is desirable from a cost standpoint.

It is inconvenient, but certainly not impossible, to provide a liquid concentrate which is essentially water-free. Solid or liquid high-foaming surfactants of essentially 100% organic content are available, as is 100% phosphoric acid. In fact, by using an excess of $P_2O_5$, a "phosphoric acid" which is the equivalent of more than 100% $H_3PO_4$ can be provided in a known manner.

If desired, sufficient amine can be included in compositions of this invention such that all acidic components in the composition are in the form of organic ammonium salts. Other preferred cations for these salts include $NH_4$ and the alkali metal cations, of which $Na^+$ and $K^+$ are the most readily available. Other water soluble cations are suitable, provided they do not enter into undesirable side reactions with the components of the phosphatizing composition.

In the case of liquid phosphatizing concentrates, it is preferred that the concentrate be diluted to the use concentration with a cheap, readily available solvent or liquid carrier such as water. Water can be a suitable diluent for the use solution, even for essentially 100% organic concentrates. Typical use solutions are formed by mixing 100–2,000 parts of water with each 100 parts of concentrate, whereby the phosphoric acid or phosphate in the use solution is brought down to a concentration within the range of about 0.2–5% by weight, e.g. .75–4%.

As is known in the art, a variety of additional ingredients can be included in the phosphatizing composition, e.g. buffering agents such as silicofluorides.

A wide variety of acidic materials can be neutralized with organic amines to form organic ammonium buffer salts. These acidic materials are available in various forms, including aqueous solutions ranging in concentration from 10 to 95% by weight. The alkali metal salts (e.g. Na and K salts) of these acids can also be used, but (in the case of the fluosilicates) are far less soluble. In fact, the organic ammonium salts are more soluble than the ammonium ($NH_4$) species.

The preferred salts from which ammonium, organic ammonium, or alkali metal buffering salts are formed include fluozirconic acid ($H_2ZrF_6$), fluotitanic acid ($H_2TiF_6$), and the like. Organic carboxylic acids which are water soluble, which form water soluble organic ammonium salts, and which have a $pK_a$ within the range of about 2 to 7, e.g. acetic acid, can also be used, as can the relatively more odor-free hydroxycarboxylic acids. In any event, the aforementioned inorganic fluorinated acids are preferred, i.e. acids of the formula $H_2MF_6$, wherein M is an element of Group IVA or Group IVB of the Periodic Table.

The organic amines used to neutralize the buffering agents can be the same as those used to neutralize the phosphoric acid. These amines are ordinarily monofunctional (with respect to amine functionality) and are ordinarily at least strong enough to form salts which, if hydrolyzed in 0.1 molar concentration, will result in an aqueous solution with a pH within the range of about 3.0 to about 5.5, preferably from about 3.8 to about 5.2, particularly within the temperature range of 20°-70° C. Thus, these organic amines will typically have a $pK_b$ ranging from about 3 to about 10, preferably 3 to 5. (In this context, the $pK_b$ value refers to $-1$ times the log of $K_{diss}$, the dissociation constant). Although these amines are ordinarily monofunctional in their salt-forming capabilities, they can contain other functional groups such as oxo radicals (hydroxyls, ethers, etc.) and the like.

These amines can be primary, secondary, or tertiary, primary and secondary amines being preferred. The organic radicals substituted on the nitrogen atom are ordinarily aliphatic, substituted aliphatic (e.g. hydroxyaliphatic), cycloaliphatic, or any other organic group which does not have an adverse inductive effect or dislocation effect upon the unbonded pair of electrons on the nitrogen. As noted previously, the preferred amines are the alkanol amines (e.g. monoethanolamine, diethanolamine, propanolamine, etc.), water soluble lower alkyl amines (i.e. the $C_1$-$C_6$ monoalkylamines, the $C_1$-$C_4$ dialkylamines, etc.), cyclohexylamine, and heterocyclicamine such as morpholine.

These amines, for the most part, are gases or liquids. They can be added to the composition as such or in concentrated aqueous solutions.

In addition to the high-foaming surfactants described in detail subsequently, surface active agents can be included in the compositions of this invention for a variety of other functions including wetting and lowering of surface tension, cleaning, emulsifying, and coupling (i.e. liquid phase stabilization and prevention of phase separation). Any additional surface active agents should be carefully selected so as not to interfere with the foam-providing or foam-stabilizing action of the highfoaming surfactant.

As mentioned previously, foamable phosphatizing concentrates can be in solid form, e.g. powder, flakes, and the like. If desired, these dry compositions can be formulated such that they can be diluted to the use concentration with no solvent other than water. In these dry solid compositions, the antibronzing agents and accelerators can be essentially the same compounds used in liquid concentrates. The phosphates can also be substantially the same, the preferred phosphates being $NaH_2PO_4$ and $KH_2PO_4$. If a buffering action is desired, solid alkali metal silicofluorides can be included.

The monoalkali metal dihydrogen phosphates can be used alone or in combination with other phosphates or even concentrated phosphoric acid (which does not alter the generally dry solid nature of the composition). Similarly, liquid and solid high-foaming surfactants are available which can be included in dry solid compositions. Among these are the organic sulfonates and organic sulfates, many of which are available in flake or powdered form.

THE HIGH-FOAMING SURFACTANT

A wide variety of high-foaming surface active agents are available from the generic classes of anionic, nonionic, amphoteric, and cationic surfactants. If blended at the point of use, there are few if any limitations on the type or number or combinations of surfactants which can be used. However, when concentrated liquid products are made and stored for periods of time prior to use, an acid stable surfactant is preferred and - depending upon the nature of the total composition - may be essential.

All high-foaming surface active agents do not work with equal effectiveness, and the anionic classes are particularly suitable, due to the relatively effective foam-stabilizing effects provided by these agents. Optimum results are obtained with the alkyl benzene sulfonates (particularly those containing $C_{10}$ to $C_{14}$ alkyl chains, which are normally straight chains), alkyl sulfates (e.g. lauryl sulfate), and alkyl ether sulfates such as lauryl ether sulfate.

Among the nonionic high-foaming surface active agents, alkyl phenol ethylene oxide adducts are useful by themselves, but are particularly preferred when used in combination with anionic high-foaming surfactants. Octyl or nonyl phenol condensed with 8 to 15 oxyethylene units are preferred. These nonionic agents are generally known to be useful for emulsifying and degreasing and are not as effective as the anionics in producing a stable foam. Other nonionic surfactants with foam-forming or foam-boosting properties include alkyl polyether surfactants, block polymers and random polymers containing oxyethylene and oxypropylene units, amine oxides (such as lauryl amine oxide, which can produce relatively stable foams), and alkanol amides such as the lauric and coco-derived alkanol amides.

As is known in the art, amphoteric surfactants also have foam-forming or foam-boosting capabilities, when used alone or in combination with other surfactants. Commercially available amphoteric surfactants with foam-forming properties include dicarboxylic coconut derivatives of substituted imidazoline, e.g. "MIRANOL C-2M" (trade designation of the Miranol Chemical Company).

The chemical class to which the surfactant belongs is ordinarily less important than certain key physicochemical properties such as compatability with other components of the composition, solubility in the system and/or liquid carriers or solvents included in the system, and foam stabilizing capabilities relative to the dwell time that would be used or desirable in a given operation.

When combinations of high-foaming surfactants are used in compositions of this invention, it is not necessary that every surfactant in the combination meet all of the Ross-Miles foam height test requirements described previously. That is, some high-foaming surfactants can be used which, tested individually, show substantial foam decay after five minutes, even in a test with zero hardness water. However, it is desirable that the combination of surfactants, tested as a combination, exhibits a high initial foam height and a relatively minor amount of foam decay after five minutes. For example, a nonyl phenoxy polyethoxy ethanol containing 9 to 10 oxyethylene units has a relatively low initial Ross-Miles foam height (125 mm) and exhibits substantial foam decay (to 25 mm after five minutes, both initial and five minute values having been determined in 0.3% by weight concentration and 120° F. water of zero hardness). Nevertheless, this surfactant is useful in combination with an anionic highfoaming surfactant of the sulfate or sulfonate type. As will be apparent from the foregoing discussion, virtually all of the alkyl and aralkyl sulfates and sulfonates containing higher alkyl chains (preferably straight chains having more than 10 carbon atoms) will produce an initial Ross-Miles foam height in excess of 100 mm (more typically in excess of 200 mm in 0.2 concentration in 50° C. water of 0 – 50ppm hardness or even up to 300ppm hardness) and the foam decay after five minutes can be less than 15 or 20 mm. These sulfates and sulfonates can be considered to be in essence the corresponding organic sulfuric or organic sulfonic acids neutralized stoichiometrically (or with a slight excess or deficiency) with suitable bases such as the alkali metal hydroxides (NaOH, KOH, etc.), amines (such as the alkanol amines, particularly the mono-, di-, and triethanol amines), and the like. As is known in the art, excess sodium or potassium or alkanol amine salts can be combined with the surfactant, whereby the surfactant will contain some sodium sulfate or the like.

Another class of compounds known in the art to assist in the production of foam is the polypeptides, which can be in neutralized or non-neutralized form. For example, reasonably stable fire-extinguishing foams have been produced with the aid of waste proteinaceous material.

The high-foaming surfactants particularly preferred for foamable phosphatizing compositions of this invention generally belong to one of the following classes of materials: alkyl sulfonates (including straight-chain alkyl sulfonates and aralkyl sulfonates); higher alkyl sulfates (particularly the straight chain type); alkyl ether sulfates; corresponding acids of these sulfonates and sulfates; alkyl phenoxy polyethoxy ethanols (particularly the nonyl phenoxy and isooctyl types containing several oxyethylene units); alkyl, ethyl cycloimidinium, 1-hydroxy, 3-ethyl alcoholate, 2-methyl carboxylate (for example, see Mannheimer, U.S. Pat. No. 2,528,378, issued Oct. 31, 1950), alkyl amine oxides; polypeptides; and fatty acid diethanol amides.

Phosphate esters have also been used in foam-forming compositions. Among the commercial embodiments of such esters are the following: "Ultraphos" II (trademark of Witco Chemical Company), Rohm and Hass QS30, and PE-340 (trade designation of Economics Laboratory, Inc.).

ORGANIC SOLVENTS AND COUPLING AGENTS

In those cases in which coupling agents are desirable, the preferred agent is an aromatic sulfonic acid such as xylene sulfonic acid. The preferred organic solvents are the degreasing solvents, e.g. aliphatics, cycloaliphatics, aromatics, and other hydrocarbons and substituted hydrocarbons, particularly those with a high flask point. For both good degreasing properties and a flash point above 85° F., high-boiling hydrocarbons and/or chlorinated hydrocarbons are suitable. Chlorinated aliphatics (such as $CH_2Cl_2$) can boil at temperatures barely above room temperature (e.g. about 40° C.) without increasing fire hazards. Hydrocarbons having initial boiling points above 180° F., preferably above 285° F. have relatively high flash points and are also relatively safe to use. High-flash aromatics, for example, boil at 360°–450° F. (180°–235° C.) and have Cleveland Open Cup (C.O.C.) flash points above 65° C.

PREFERRED PROPORTIONS OF COMPONENTS

In the preferred compositions of the invention, particularly the liquid concentrate type, use solutions are obtained after dilution with water. The preferred use (diluted) solutions contain 0.2–5 wt.-% phosphate (preferably organic ammonium phosphate), 0.1–1.5% by weight of the buffer (an optional component); 0.01–1.0% by weight of a nitrated aromatic accelerator (if an accelerator is used); and 0.25–5 wt.-% of the high-foaming surfactant system. The balance of the "use" composition can comprise a suitable liquid carrier system, e.g. water or water and organic solvents.

In the following non-limiting illustrative Examples all parts and percentages are by weight unless otherwise indicated.

EXAMPLES 1–5

Five liquid foamable phosphatizing compositions were used in a realistic field test of this invention. The foam applicator was the 10 gallon standard "Foam and Clean" (trademark) unit commercially available from Economics Laboratory, Inc. The "Foam and Clean" unit was pressurized to 60 pounds per square inch (p.s.i.), the air valve was set in the full open position, and the valve for the foamable phosphatizing composition in the tank was set in the one-third open position. No hot water was used in applying the foam. The surface of the three-dimensional metal part to be phosphatized was oily. The part was fully coated with the foam, and the foam was allowed to dwell on the part until it began to slide off under the influence of gravity. The part was then totally rinsed with water heated to 180° F. The part was allowed to air dry and was then painted.

Each of the five foamable phosphatizing compositions contained the following active ingredients and diluents:

a. a phosphatizing concentrate including phosphoric acid, hydrofluosilicic acid (for buffering), molybdenum trioxide (anti-bronzing agent), and xylene sulfonic acid (coupler), all neutralized with monoethanol amine;
b. sodium m-nitrobenzene sulfonate (the accelerator);
c. a high-foaming surfactant system (described subsequently);
d. except in the case of Example 4, a hydrocarbon solvent containing over 90% aromatics with a flash point of 150° F., C.O.C. ("Aromatic 150", trademark of Exxon); and
e. water, 6–9.1 parts by volume for each 0.9–4 parts by volume of the combination of components (a) through (d).

Laboratory phosphatizing was also carried out on vertically hung ASTM D-609 test panels ("Q-Panel, Type S", a trademark of the Q-Panel Company) with both single and double passes of the foam spray, thereby providing a contact (dwell) time of 60 seconds (for the single pass) and 90 seconds (for the double pass). The foam on the vertical ASTM D-609 panels slid off more or less completely at the end of the dwell time. Typical coating weights obtained for these dwell times were 40–45 mg/ft$^2$.

The combination of the above-listed components (a) through (e) provided the five liquid foamable phosphatizing compositions described in the following table.

| COMPONENT | AMOUNT IN % BY WEIGHT Ex. 1 | Ex. 2 | Ex. 3 | Ex. 4 | Ex. 5 |
|---|---|---|---|---|---|
| Phosphoric acid | 3.90 | 1.30 | 1.82 | 1.82 | 3.90 |
| Hydrofluosilic acid | 0.90 | 0.30 | 0.42 | 0.42 | 0.90 |
| Monoethanolamine | 2.40 | 0.80 | 1.12 | 1.12 | 2.40 |
| m-Nitrobenzene-sulfonate | 0.15 | 0.05 | 0.07 | 0.07 | 0.15 |
| Molybdenum Trioxide | 0.03 | 0.01 | 0.014 | 0.014 | 0.03 |
| Water | 83.87 | 89.29 | 90.006 | 95.006 | 74.87 |
| Aromatic solvent ("Aromatic 150") | 4.75 | 4.75 | 4.75 | — | 4.75 |
| Xylene sulfonic acid | 0.45 | 0.15 | 0.21 | 0.21 | 0.45 |
| High-Foaming Surfactant System: | | | | | |
| (i) n-alkyl benzene sulfonate | 0.30 | 0.10 | 0.14 | 0.14 | 0.30 |
| (ii) sodium lauryl ether sulfate | 3.00 | 3.00 | 1.20 | 1.20 | 12.00 |
| (iii) nonyl phenol-ethylene oxide adduct (9–10 ethyleneoxy units) | 0.25 | 0.25 | 0.25 | — | 0.25 |
| TOTALS | 100.00 | 100.00 | 100.00 | 100.00 | 100.00 |

EXAMPLE 6

The procedures of Examples 1–5 were followed with the following liquid concentrate.

| Component | Amount in % by Wt. |
|---|---|
| Phosphoric acid | 26.0 |
| Sodium molybdate | 0.5 |
| m-Nitrobenzene sodium sulfonate | 1.0 |
| Monoethanolamine | 8.5 |
| Aromatic solvent ("Aromatic 150", trademark of Exxon) | 34.0 |
| n-Alkyl sulfonic acid | 30.0 |
| | 100.0 |

For use, one and one-half parts by volume of this concentrate were diluted with 8.5 parts by volume of water.

EXAMPLE 7

A concentrate was prepared and diluted according to the procedures of Example 6. The concentrate, prior to dilution, had the following composition.

| Component | Amount in Parts by Wt. |
|---|---|
| Phosphoric acid | 9.00 |
| Sodium molybdate | 0.20 |
| m-Nitrobenzene sodium sulfonate | 0.40 |
| Monoethanolamine | 7.93 |
| Aromatic Solvent ("Aromatic 150", trademark of Exxon) | 40.00 |
| n-Alkyl sulfonate | 20.00 |

The pH of the concentrate was 3.8. The use solution was made by mixing 1.5 parts (by volume) of the concentrate with 8.5 parts (by volume) of water.

EXAMPLES 8 and 9

The following compositions were dry particulate solids. Dilution with water to a use concentration of 2 – 8% provided the use solutions.

| Component | Ex. 8 | Ex. 9 |
|---|---|---|
| Monosodium phosphate | 76.4 | 43.4 |
| Sodium acid pyrophosphate | — | 30.0 |
| Phosphoric acid, aq., 75% | 2.0 | — |
| Sodium molybdate | 0.6 | 0.6 |
| 2,4-Dinitrobenzene sodium sulfonate | 1.0 | — |
| m-Nitrobenzene sodium sulfonate | — | 1.0 |
| Sodium silicofluoride | — | 5.0 |
| n-alkyl sulfonate, 90% flake | 20.0* | 20.0 |

*alpha olefin sulfonate can be substituted.

What is claimed is:

1. A method of phosphatizing a metallic drainable surface, comprising the steps of:

A. providing a mixture comprising:

a. a phosphatizing composition containing at least 0.2% by weight of phosphate anions and having a pH ranging from about 3.0 to about 5.5;

b. at least about 0.25 parts by weight, per 100 parts by weight of said phosphatizing composition, of a high-foaming surfactant having an initial Ross-Miles foam height in excess of 100 mm. determined at 0.1% by weight concentration in water in a column of zero hardness water maintained at 50° C.; and c. a volume of gaseous fluid which is relatively larger than the combined volume of said phosphatizing composition and said high-foaming surfactant; said gaseous fluid being gaseous at normal ambient temperatures;

B. generating an adherent foam spray comprising the mixture provided by said step (A) and directing said foam spray onto said metallic drainable surface to obtain an adherent foam deposit on said metallic drainable surface;

C. permitting said adherent foam deposit to adhere to said drainable surface until a phosphate coating weight of at least 10mg/ft$^2$ is obtained and until said adherent deposit has been in place on said surface for a single-pass, actual dwell time which inherently corresponds to a single-pass, vertical, ASTM D 609-61 panel dwell time of about 10-180 seconds whereby the resulting phosphatized metallic drainable surface, after draining of foam deposits therefrom, has an adherent phosphate coating weight of at least 10mg/ft², but is substantially free of powdery, nonadherent deposits.

2. A method according to claim 1 wherein draining of said foam deposits from said metallic drainable surface is permitted to occur spontaneously at the end of a single-pass actual dwell time which inherently corresponds to a single-pass, vertical, ASTM D 609-61 panel dwell time of about 30-100 seconds, said actual dwell time being generally within the range of 100%-5,000% of said single-pass, vertical, ASTM D 609-61 panel dwell time.

3. A method according to claim 1 wherein the single-pass, vertical, ASTM D 609-61 panel dwell time is selected by selecting the amount and type of said high-foaming surfactant and the amount of said gaseous fluid in the mixture of said step (A).

4. A method according to claim 1 wherein said gaseous fluid is air.

5. A method according to claim 4 wherein the volume: volume ratio of said air to the combined volume of phosphatizing composition and high-foaming surfactant ranges from about 10:1 to 30:1.

6. A method according to claim 1 wherein the drawing of said foam deposits from said metallic drainable surface is induced by a rinsing step.

7. A method according to claim 1 wherein the actual dwell time ranges from about 30 seconds to about 10 minutes.

8. A method according to claim 1 wherein said metallic drainable surface is a non-horizontal metallic surface of a three-dimensional object.

9. A method according to claim 1 wherein said phosphatizing composition comprises:

0.75-4.0% by weight phosphoric or polyphosphoric acid;

at least about one equivalent of an amine for each 3 equivalents of said acid;

0-1.5% by weight of an agent selected from the group consisting of an accelerator, a debronzing agent, and mixtures thereof;

0-1.5% by weight of a compound of the formula $H_2MF_6$, wherein M is an element of Group IVA or IVB of the Periodic Table; and substantially the balance of said composition being a liquid carrier selected from the group consisting of water, a substantially hydrocarbon solvent, and mixtures thereof.

10. A method according to claim 9 wherein said high foaming surfactant comprises an alkali metal salt of an alkyl sulfonic or surfuric acid or an alkyl-aryl sulfonic acid, or a mixture thereof.

11. A method for phosphatizing a three-dimensional object having exposed metallic surfaces comprising the steps of:

a. locating said object so that at least one of the metallic surfaces to be phosphatized is a drainable surface;

b. blending 0.2 to 5 parts by weight of an organic ammonium phosphate with 0.1-1.5 parts by weight of an organic ammonium fluosilicate; 0.01-1.0 parts by weight of a nitrated aromatic accelerator; 0.25-5 parts by weight of a high-foaming surfactant having an initial Ross-Miles foam height in excess of 100 mm. determined at 0.1% by weight concentration in water in a column of zero hardness water maintained at 50° C., selected from the group consisting of an alkyl-aryl sulfonate, an alkyl-phenolethylene oxide adduct, an alkyl ether sulfate, and mixtures thereof; essentially the balance of the resulting mixture being a liquid carrier selected from the group consisting of water, an aromatic liquid solvent, and mixtures thereof; said resulting mixture having a pH ranging from about 3.0 to about 5.5;

c. generating a foam from said mixture of said step (b) and a greater volume of air, relative to the volume of said mixture; and spraying said foam onto a said drainable surface, said volume of air being selected to provide an actual dwell time of foam deposit on said drainable surface, which actual dwell time is at least long enough to provide an adherent phosphate layer on said drainable surface in excess of 10mg/ft² but not long enough to create powdery, non-adherent deposits; said actual dwell time ranging from about 30 seconds to about 20 minutes; and d. causing downward draining of the foam deposits, resulting from the spraying according to said step (c), on said drainable surface.

12. A method according to claim 11 wherein said downward draining is caused by the force of gravity on the foam deposits, after the foam deposits have lost adherence to said drainable surface.

13. A method according to claim 12 comprising the further step of rinsing said drainable surface with an aqueous spray after the completion of said step (d).

14. A foamable phosphatizing composition comprising, by weight, 1.3 to 3.9% phosphoric acid; 0.3 to 0.95 hydrofluosilic acid; 0.8 to 2.4% monoethanolamine; 0.05 to 0.15% m-nitrobenzene-sulfonate; 0.01 to 0.03% molybdenum trioxide; 4.75% aromatic solvent; 0.15 to 0.45% xylene sulfonic acid; 0.14 to 0.3% n-alkyl benzene sulfonate said sulfonate having an initial Ross-Miles foam height in excess of 100 mm. determined at 0.1% by weight concentration in water in a column of zero hardness water maintained at 50° C.; 1.2 to 12% sodium lauryl ether sulfonate; 1.2 to 12% sodium lauryl ether sulfate; 0.25% nonyl phenolethylene oxide adduct; and 74.87 to 95.006% water; said composition having a pH in the range of about 3 to about 5.5.

15. A foamable phosphatizing liquid concentrate comprising: by weight, 9 to 26% phosphoric acid, 0.2 to 0.5% sodium molybdate, 0.4 to 1% m nitrobenzene sodium sulfonate, 7.93 to 8.5% monoethanolamine, 34 to 40% aromatic solvent and 20 to 30% of a member selected from the group consisting of n-alkyl sulfonic acid and n-alkyl sulfonate, said member having an initial Ross-Miles foam height in excess of 100 mm. determined at 0.1% by weight concentration in water in a column of zero hardness water maintained at 50° C.

16. The foamable phosphatizing liquid concentrate of claim 15 wherein said concentrate includes, by weight, 9% phosphoric acid, 0.2% sodium molybdate, 0.4% m-nitrobenzene sodium sulfonate, 7.93% monoethanolamine, 40% aromatic solvent and 20% n-alkyl sulfonate.

17. The foamable phosphatizing liquid concentrate of claim 15 wherein said concentrate includes by weight, 26% phosphoric acid, 0.5% sodium molybdate, 1% m-nitrobenzene sodium sulfonate, 8.5% monoethanolamine, 34% aromatic solvent and 30% n-alkyl sulfonic acid.

18. A foam phosphatizing composition comprising: air and a liquid, said liquid comprising:

| Parts by Weight | |
|---|---|
| 0.75–4 | Phosphoric acid; |
| 0.01–1.5 | an accelerator system comprising a compound selected from the group consisting of a molybdenum oxide, a molybdate salt, a nitrated aromatic sulfonic acid, a nitrated aromatic sulfonate, and mixtures thereof; |
| 0.25–10 | at least one high foaming surfactant having an initial Ross-Miles foam height in excess of 100 mm. determined at 0.1% by weight concentration in water in a column of zero hardness water maintained at 50° C., said surfactant selected from the group consisting of an alkyl sulfonate; an alkyl sulfate; an alkyl ether sulfonate; corresponding acids thereof; an alkyl phenoxy polyethoxy ethanol; alkyl, ethyl cycloimidinium, 1-hydroxy, 3-ethyl alcoholate, 2-methyl-carboxylate; alkyl amine oxide; neutralized or non-neutralized polypeptide; and fatty acid diethanol amide; |
| 0–100 | organic liquid solvent having a flash point of excess of 85° F. and an initial boiling point in excess of 180° F.; |
| 0–100 | water; |

said composition further containing about 1–3 equivalents of an amine for each three equivalents of phosphoric acid; the pH of said composition being in the range of about 3.0 to about 5.5, said foam having sufficient volume of air per volume of liquid to provide a foam having a controlled degree of stability and capable of adhering to overhead, inclined or vertical metal surface.

19. A foam phosphatizing composition comprising: gaseous fluid and a liquid, said liquid comprising:

0.75–4.0% by weight phosphoric or polyphosphoric acid; at least about one equivalent of an amine for each 3 equivalents of said acid;

0–1.5% by weight of an agent selected from the group consisting of an accelerator, a debronzing agent, and mixtures thereof;

0–1.5% by weight of a compound of the formula $H_2MF_6$ wherein M is an element of Group IV A or IV B of the Periodic Table;

at least one high-foaming surfactant having an initial Ross-Miles foam height in excess of 100 mm. determined at 0.1% by weight concentration in water in a column of zero hardness water maintained at 50° C; and substantially the balance of said liquid being a liquid carrier selected from the group consisting of water, a substantially hydrocarbon solvent, and mixtures thereof; said gaseous fluid being present in an amount sufficient to provide moderately stiff foam capable of remaining in adherent bonding contact with a vertical metal surface until a phosphate coating weight in excess of 10 mg/ft$^2$ is obtained, the pH of said composition being in the range of about 3.0 to about 5.5, said foam being sufficiently wet to flow under the influence of gravity once the adherent bond between the foam and metal surface relaxes or is broken by chemical change.

* * * * *

UNITED STATES PATENT AND TRADEMARK OFFICE

CERTIFICATE OF CORRECTION

PATENT NO. : 4,060,433

DATED : November 29, 1977

INVENTOR(S) : Gerald W. Chunat, James E. Maloney

It is certified that error appears in the above-identified patent and that said Letters Patent are hereby corrected as shown below:

In column 2, line 3, "totlly" should be --totally--.
In column 3, line 39, "allowd" should be --allowed--.
In column 4, line 55 and 56, "U.S. U.S." should be --U.S.--.
In column 6, line 10, "phosphatizing" should be --phosphating--.
In column 7, line 52, "directe" should be --directed--.
In column 8, line 35, after "and" insert --then--.
In column 13, line 68, "flask" should be--flash--.
In column 17, lines 27 and 28, "drawing" should be --draining--.
In column 18, line 15, "0.95" should be --0.9%--.

Signed and Sealed this

Eighteenth Day of April 1978

[SEAL]

Attest:

RUTH C. MASON
Attesting Officer

LUTRELLE F. PARKER
Acting Commissioner of Patents and Trademarks